United States Patent [19]

Liaw

[11] Patent Number: 4,881,915

[45] Date of Patent: Nov. 21, 1989

[54] DINOSAUR EGG

[75] Inventor: J. Y. Liaw, Taipei, Taiwan

[73] Assignee: Li'l Mort Sales, Chicago, Ill.

[21] Appl. No.: 178,297

[22] Filed: Apr. 4, 1988

[51] Int. Cl.[4] ..... A63H 23/00; A63H 33/00; A63H 3/00; A63H 3/36

[52] U.S. Cl. ..... 446/153; 446/14; 446/368; 446/385; 272/27 N

[58] Field of Search ..... 446/14, 71, 72, 73, 446/76, 79, 153, 159, 310, 311, 320, 368, 369, 385; 272/27 N; 273/DIG. 8; 43/54.1

[56] References Cited

U.S. PATENT DOCUMENTS

| | | | |
|---|---|---|---|
| 608,794 | 8/1989 | Ouinn | 446/310 |
| 685,345 | 10/1901 | Perkins et al. | 446/310 |
| 722,731 | 3/1903 | MacKaye | 272/27 N |
| 2,760,302 | 8/1956 | Cheskin | 446/153 X |
| 2,952,462 | 9/1960 | Planin | 273/157 R |
| 3,091,053 | 5/1963 | Growald | 446/320 X |
| 3,238,599 | 3/1966 | Bauman | 446/369 X |
| 3,680,250 | 8/1972 | Hetrick | 43/54.1 |
| 4,106,657 | 8/1978 | Dogliotti | 446/71 X |
| 4,481,326 | 11/1984 | Sonenstein | 524/377 |
| 4,529,569 | 7/1985 | Palau | 446/153 X |

*Primary Examiner*—Robert A. Hafer
*Assistant Examiner*—D. Neal Muir
*Attorney, Agent, or Firm*—Fleit, Jacobson, Cohn, Price, Holman & Stern

[57] ABSTRACT

A realistic hatching of a dinosaur occurs from an egg-like storage container. A transluscent egg sheel includes a series of crack lines, which forms weakened fault lines on the surface of the eggshell. A compressed sponge dinosaur is located within the eggshell. Opening at the ends and/or sides of the eggshell allow water to enter the shell when the egg is placed in hot water of a preferred temperature of 50°-60° C. The water entering the shell, after approximately 5 to 10 minutes, causes the compressed sponge dinosaur to expand and break through the eggshell at random points on the shell, preferably along the molded crack lines of lesser thickness than the remainder of the eggshell. The rupturing of the shell occurs at its weakest points, as affected by the depth of the preformed cracks in the shell as well as the portions of the shell which have dissolved due to the exposure to hot water. The expanding dinosaur will, therefore, rupture the egg at one or more locations where the shell has been weakened due to its melting or dissolution due to contact with water.

13 Claims, 1 Drawing Sheet

DINOSAUR EGG

FIELD OF THE INVENTION

This invention relates to a water soluble container which contains a compressed sponge in the form of a dinosaur. Upon entry of water into the container, the sponge expands to force the container to break apart and simulate the emergence of a dinosaur being hatched from an egg.

BACKGROUND OF THE INVENTION

Compressed sponge animals are known to be contained within a thin, water soluble capsule. The capsule is usually placed into warm water, where it reacts with the water to completely dissolve. After the capsule dissolves, water contacts the sponge and causes the sponge to expand.

An example of such a capsule is disclosed in U.S. Pat. No. 3,680,250 to Hetrick. In this patent, a fishing lure is housed within a water-soluble capsule. When the lure is to be used, the capsule is immersed in water, the capsule dissolves, and the lure is released.

In U.S. Pat. No. 4,481,326 to Sonenstein, a water soluble film of polyvinyl alcohol and polyvinyl pyrrolidone is disclosed. This patent teaches use of films which are rapidly soluble in cold and warm water and are formed from blends of water soluble polyvinyl alcohol (partially hydrolyzed polyvinyl acetate) and polyvinyl pyrrolidone. These polymers are compatible and form homogeneous mixtures from which clear, transparent, non-tacky, easily handlable, mechanically strong films can be formed.

In U.S. Pat. No. 3,091,053 to Growald, a foamable resin and catalyst in an inactivated or unfoamed state is located in a collapsed envelope located within two halves of a releasable shell. Upon application of heat to the shell, the critical temperature of the foamable plastic is reached, and a rapid volumetric expansion takes place within the plastic envelope which is shaped in the form of an animal. A joint formed between the two halves of the shell fails, thus releasing the filled envelope in the shape of an animal from within the shell through the separated shell joint.

SUMMARY OF THE PRESENT INVENTION

By the present invention, a realistic hatching of a prehistoric dinosaur occurs from a storage container. A transluscent eggshell includes a series of crack lines, which forms weakened fault lines on the surface of the eggshell. A compressed sponge dinosaur is located within the eggshell.

Openings at the ends and/or sides of the egg shell allow water to enter the shell when the egg is placed in hot water of a preferred temperature of 50°-60° C. The water entering the shell, after approximately 5 to 10 minutes, causes the compressed sponge dinosaur to expand and break through the eggshell at random points on the shell, preferably along the molded crack lines which are of lesser thickness than the remainder of the eggshell. The rupturing of the shell occurs at its weakest points, as affected by the depth of the preformed cracks in the shell as well as from the portions of the eggshell which have softened due to the exposure to hot water or partially dissolved. The expanding dinosaur will, therefore, rupture the egg at one or more locations where the shell has been weakened due to its melting or softening due to contact with water.

It is an object of the present invention to provide a compressed sponge dinosaur within an egg enclosure.

It is yet another object of the present invention to provide a compressed sponge dinosaur within an egg enclosure where the ends of the egg are cracked or open to allow entry of water.

It is still another object of the present invention to provide a compressed sponge dinosaur within an egg enclosure where the ends of the egg are cracked to allow entry of water such that the water entering the egg causes the compressed sponge dinosaur to expand and break through from a softened or melted portion or portions of the egg.

It is still yet another object of the present invention to provide a compressed sponge dinosaur within an egg enclosure where the ends of the egg are cracked to allow entry of water such that the water entering the egg causes the compressed sponge dinosaur to expand and break through a softened or melted portion or portions of the egg to simulate the hatching of a dinosaur from its egg.

These and other objects of the invention, as well as many of the intended advantages thereof, will become more readily apparent when reference is made to the following description taken in conjunction with the following drawings.

DETAILED DESCRIPTION OF THE PREFERRED EMBODIMENT

Figure 1:
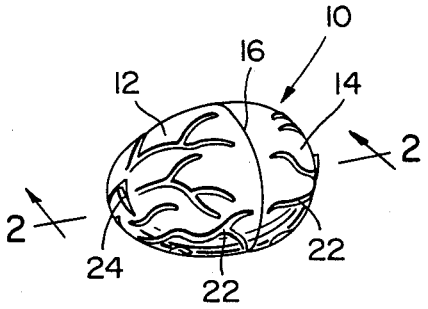
FIG. 1 is a side view of a plastic eggshell.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
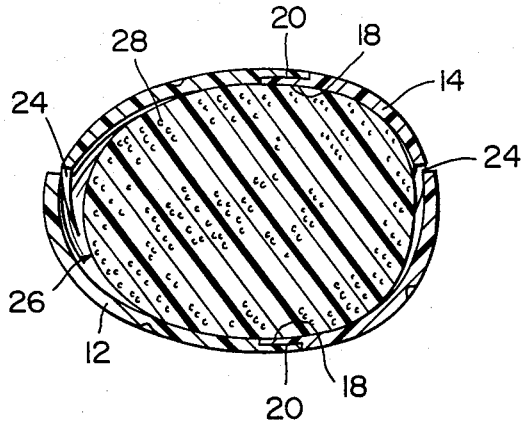
FIG. 2 is a section view taken along line 2—2 of FIG. 1.

With reference to the drawings in general, and to FIGS. 1 and 2 in particular, a dinosaur eggshell 10, embodying the teachings of the subject invention, is shown. The eggshell 10 includes two portions 12 and 14. Portions 12 and 14 are joined along seam 16. Seam 16 is formed as a result of melting or adhering a projecting portion 18 of portion 14 onto an overlapping portion 20 of portion 12.

Eggshell 10 is made of a translucent plastic that allows viewing of the color of the compressed sponge animal located within the eggshell. A preliminary determination of the color of the animal to be released from the eggshell is thereby possible. The eggshell is made from a compound of polyethylene oxide and polyvinyl alcohol (PVA).

Extending across the surfaces of portions 12 and 14 are random fracture lines 22, which are recessed into the surface of portions 12 and 14 and form the appearance of cracks of an eggshell. The fracture lines are recessed into the surface of the eggshell. The thickness of the plastic at the fracture lines is less than the remaining areas of the eggshell which do not have fracture liens.

Located at opposite ends of the portions 12 and 14 are slits or openings 24, which extend through the walls of portions 12 and 14 and allow free communication of atmosphere from the exterior to the interior of the egg 10 when the egg is above water. The slits also, therefore, allow free unrestricted passage of water from the exterior to the interior of the eggshell 10 when the eggshell is submerged in hot water. The slits are positioned on the eggshell to allow at least some entry of water into the cavity when the eggshell is placed in water.

Housed within the eggshell portions 12 and 14 in a cavity 26 is a compressed sponge animal FIG. 28. In this particular instance, the sponge 28 in its expanded form is in the shape of a dinosaur. The sponge 28 may be of a color such as yellow, blue, or red which is seen through the translucent shell so as to give a prior indication of the color of the dinosaur which emerges from the shell.

Figure 4:
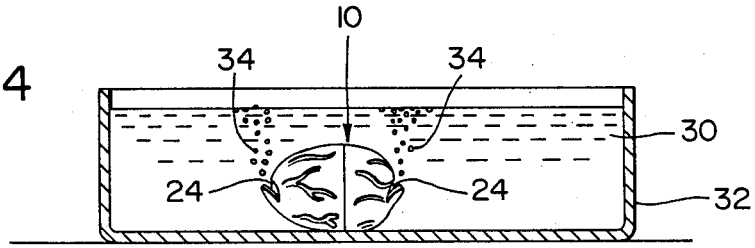
FIG. 4 is a side view of an eggshell submerged in water.

In FIG. 4, the shell 10 is shown immersed in hot water 30, preferably of a temperature in the range of 50°–60° C. held in a container 32. Due to the slits 24, the water is allowed to enter the interior cavity 26 of the shell and force air out of the cavity, which is shown in the form of escaping air bubbles 34. Water entering the cavity is absorbed by the sponge 28 and causes the sponge to begin to expand. In addition, the heat of the water into which the eggshell has been immersed begins at first to soften, and then to dissolve the shell.

Figure 3:
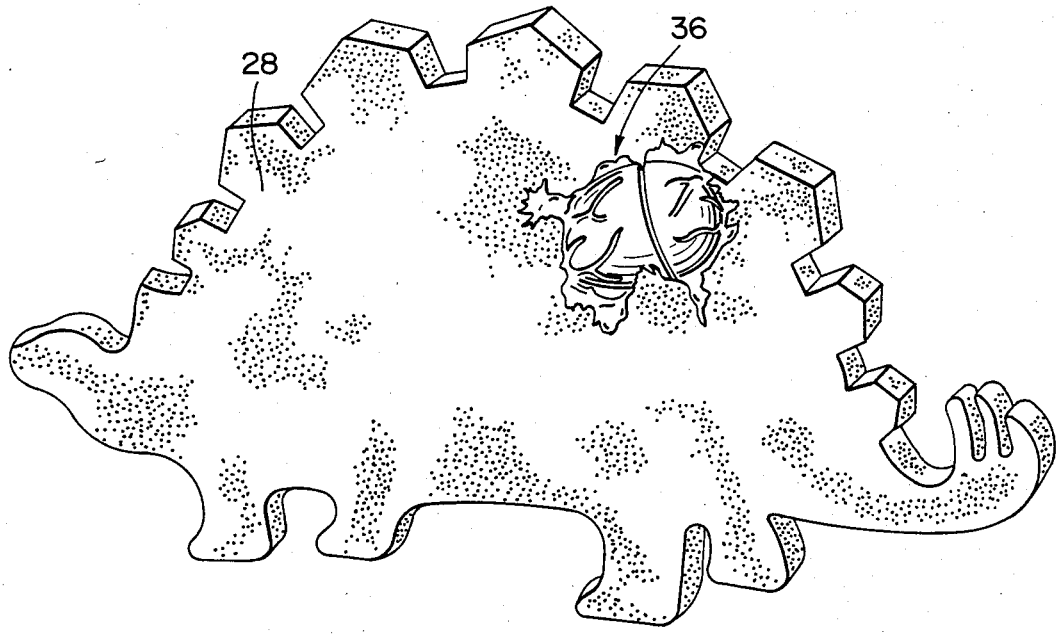
FIG. 3 is a perspective view of an expanded sponge dinosaur.

It is intended that the softening and dissolving of the shell is of a rate that will lag behind the total time required for the complete expansion of the compressed sponge. Therefore, even when the sponge has completely expanded, there will be at least a portion 36 of the shell which remains intact, as shown in FIG. 3. The portion 36 of the shell remaining on the expanded sponge demonstrates that the point of emergence of the dinosaur is not necessarily along the seam line, but rather and preferably from the slits 24 and, subsequently, by rupturing through weakened or melted spots along the recessed fracture lines 22 of the shell.

Having described the invention, many modifications thereto will become apparent to those skilled in the art to which it pertains, without deviating from the spirit of the invention as defined by the scope of the appended claims.

I claim:

1. A dinosaur egg toy comprising:

an eggshell defining a hollow cavity, weakened fracture lines randomly oriented across an exterior surface of said eggshell, a compressed sponge located within said cavity, and at least one opening formed in said eggshell to allow entry of water into said cavity for absorption by said sponge to cause said sponge to expand and rupture said eggshell at said fracture lines and emerge from said container at said fracture lines and at said at least one opening in an expanded condition.

2. A dinosaur egg toy as in claim 1, wherein said fracture lines are of a lesser thickness than remaining area of said container.

3. A dinosaur egg toy as in claim 1, wherein there are two slits formed in said container.

4. A dinosaur egg toy as in claim 3, wherein said two slits are formed at opposite ends of said container.

5. A dinosaur egg toy as in claim 1, wherein said container is translucent.

6. A dinosaur egg toy as in claim 1, wherein a portion of said container remains intact after complete expansion of said compressed sponge.

7. A combined storage container and compressed animal form, comprising:

a storage container having two portions joined together to form a hollow cavity, a compressed sponge located within said cavity and said storage container including fracture lines which are weakened and randomly oriented on an exterior surface of said storage container, and at least one slit formed in said container for free communication between said cavity and the environment surrounding said container to maintain said compressed sponge in a compressed condition when said compressed sponge is in contact with the atmosphere through said at least one slit and to allow absorption of water by said compressed sponge through said at least one slit when said storage container is immersed in water so as to cause expansion of said compressed sponge and rupture of said storage container along said fracture lines by emergence of said compressed sponge from said fracture lines and said at least one slit of said storage container in an expanded condition.

8. A combined storage container and compressed animal form as in claim 7, wherein said compressed sponge is in the form of a dinosaur.

9. A combined storage container and compressed animal form as in claim 7, wherein said container is water soluble.

10. A combined storage container and compressed animal form as in claim 7, wherein said container dissolves in water at a temperature in the range of 50°–60° C.

11. A combined storage container and compressed animal form as in claim 7, wherein there are two slits formed in said container.

12. A combined storage container and compressed animal form as in claim 11, wherein said two slits are formed at opposite ends of said container.

13. A combined storage container and compressed animal form as in claim 11, wherein said container is translucent.

* * * * *